US005924277A

United States Patent [19]

Beattie et al.

[11] Patent Number: 5,924,277

[45] **Date of Patent: *Jul. 20, 1999**

[54] ION THRUSTER WITH LONG-LIFETIME ION-OPTICS SYSTEM

[75] Inventors: John R. Beattie, Westlake Village; John D. Williams, Agoura Hills; Jesse N. Matossian, Canoga Park, all of Calif.

[73] Assignee: Hughes Electronics Corporation, El Segundo, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/767,920

[22] Filed: Dec. 17, 1996

[51] Int. Cl.[6] ..... F03H 1/00; H05H 1/00

[52] U.S. Cl. ..... 60/202; 313/360.1

[58] Field of Search ..... 60/202; 313/359.1, 313/360.1, 361.1, 362.1; 315/111.81

[56] References Cited

U.S. PATENT DOCUMENTS

| | | | |
|---|---|---|---|
| 3,311,772 | 3/1967 | Speiser et al. | 60/202 |
| 3,412,559 | 11/1968 | Sohl | 60/202 |
| 3,573,977 | 4/1971 | Banks | 60/202 |
| 3,795,833 | 3/1974 | King et al. | 60/202 |
| 4,439,684 | 3/1984 | Hemmerich et al. | 313/361.1 |
| 4,838,021 | 6/1989 | Beattie | 60/202 |
| 5,269,131 | 12/1993 | Brophy | 60/202 |
| 5,369,953 | 12/1994 | Brophy | 60/202 |
| 5,444,258 | 8/1995 | Grigoryan et al. | 313/360.1 |
| 5,448,883 | 9/1995 | Meserole, Jr. et al. | 60/202 |
| 5,551,904 | 9/1996 | Hedges et al. | 445/47 |

FOREIGN PATENT DOCUMENTS

| | | | |
|---|---|---|---|
| 468706 | 1/1992 | European Pat. Off. | 60/202 |

*Primary Examiner*—Timothy S. Thorpe
*Assistant Examiner*—Ted Kim
*Attorney, Agent, or Firm*—V. D. Duraiswamy; M. W. Sales

[57] ABSTRACT

Ion erosion of grids is reduced in an ion thruster with a multiple-grid ion-optics system. The thruster has an array of aperture sets in which aperture areas change in a perimeter region of the array. In one ion-optics system embodiment, a screen aperture area is reduced and a decelerator aperture area is increased in aperture sets that are proximate to the perimeter of the array. Prototype tests of this embodiment have illustrated significant reduction of ion erosion.

20 Claims, 5 Drawing Sheets

ION THRUSTER WITH LONG-LIFETIME ION-OPTICS SYSTEM

BACKGROUND OF THE INVENTION

1. Field of the Invention

The present invention relates generally to spacecraft propulsion systems and, more particularly, to ion thrusters.

2. Description of the Related Art

On-board propulsion systems are used to realize a variety of spacecraft maneuvers. In satellites, for example, these maneuvers include the processes of orbit raising (e.g., raising from a low Earth orbit to a geostationary orbit), stationkeeping (e.g., correcting the inclination, drift and eccentricity of a satellite's orbit) and attitude control (e.g., correcting attitude errors about a satellite's roll, pitch and yaw axes).

The force exerted on a spacecraft by a propulsion system's thruster is expressed in equation (1)

$$F = mv_e = \frac{w}{g}v_e = wI_{sp} \tag{1}$$

as the product of the thruster's mass flow rate and the thruster's exhaust velocity. Equation (1) also shows that mass flow rate can be replaced by the ratio of weight flow rate to the acceleration of gravity and that the ratio of exhaust velocity to the acceleration of gravity can be represented by specific impulse $I_{sp}$ which is a thruster figure of merit. Equation (1) can be rewritten as equation (2)

$$I_{sp} = \frac{F}{w} \tag{2}$$

to show that specific impulse is the ratio of thrust to weight flow rate.

When a thruster is used to effect a spacecraft maneuver, a velocity increase $\Delta V$ of the spacecraft is gained with a loss in mass of stored fuel. Thus, there will be a differential between the spacecraft's initial mass $M_i$ (prior to the maneuver) and the spacecraft's final mass $M_f$ (after the maneuver). This mass differential is a function of the thruster's specific impulse $I_{sp}$ as expressed by the "rocket equation" of $$M_f = M_i e^{-\left(\frac{\Delta V}{gI_{sp}}\right)} \tag{3}$$

in which $\Delta V$ has units of meters/second, $I_{sp}$ has units of seconds and a constant g is the acceleration of gravity in meter/second$^2$. Equation (3) states that fuel loss causes a spacecraft's final mass $M_f$ to exponentially decrease with increased $\Delta V$ and that this decrease can be exponentially offset by an increase in specific impulse $I_{sp}$.

Specific impulse is an important measure of a thruster's fuel efficiency. Typical specific impulses are 230 seconds for monopropellant (e.g., hydrazine) thrusters, 290 seconds for solid propellant thrusters, 445 seconds for bipropellant (e.g., liquid hydrogen and liquid oxygen) thrusters and 500 seconds for electric arc jet thrusters. In contrast, ion thrusters have been developed with specific impulses in excess of 2500 seconds.

The high specific impulse of ion thrusters makes them an attractive thruster for spacecraft maneuvers. Their high fuel efficiency can facilitate a reduction of initial satellite mass, an increased payload and a longer on-orbit lifetime. Reduction of initial mass lowers the spacecraft's initial launch cost and increased payload and longer lifetime increase the revenue that is generated by the spacecraft.

The high specific impulse of ion thrusters is accompanied by thrust levels (e.g., ~18 millinewtons in a thruster with a diameter of ~13 centimeters) which are typically less than those of more conventional thrusters. For most spacecraft maneuvers, however, these lower thrust levels are easily accommodated by increased thruster firing times. In fact, the lower thrust levels of ion thrusters can improve satellite positioning accuracy because they facilitate frequent firings. The higher thrust levels of other thruster types necessitate less frequent firings with consequent decrease in positioning resolution.

However, their longer firing times increase the lifetime requirements of ion thrusters. In a typical satellite lifetime, for example, one of the most demanding satellite maneuvers (north-south stationkeeping) requires an ion thruster lifetime in excess of 10,000 hours. Orbit raising maneuvers can further increase this requirement. Lifetimes of these magnitudes have been difficult to obtain because of cross-over ion erosion in the ion-optics system of conventional ion thrusters. The sources of this erosion are theorized to occur as shown in FIGS. 1A–1C.

These figures illustrate the formation of exemplary ion beamlets by an array of aperture sets in a typical ion-optics system. FIG. 1A shows an aperture set 20 which includes a screen aperture 21 in a screen grid 22, an accelerator aperture 23 in an accelerator grid 24 and a decelerator aperture 25 in a decelerator grid 26. Similarly, FIG. 1B shows an aperture set 30 of a screen aperture 31, an accelerator aperture 33 and a decelerator aperture 35 and FIG. 1C shows an aperture set 40 of a screen aperture 41, an accelerator aperture 43 and a decelerator aperture 45. The aperture sets 20, 30 and 40 are positioned progressively further from the center of the aperture set array.

The screen apertures 21, 31 and 41 facilitate the flow of ion beamlets 46, 48 and 50 from a plasma sheath 52 of an ion source (each line in the beamlets indicates a different ion trajectory). Each accelerator aperture is positioned relative to its respective screen aperture so that an accelerator voltage on the accelerator grid 24 attracts the accelerator aperture's respective ion beamlet and accelerates it through the accelerator aperture. Each decelerator aperture is positioned relative to its respective screen aperture so that a decelerator voltage on the decelerator grid 26 exerts a collimating force on the decelerator aperture's respective ion beamlet.

The plasma density of the plasma source typically decreases towards the perimeter of the aperture set array and, therefore, the plasma sheath 52 extends further from the screen grid 22 and initiates increasingly angled ion trajectories. This radial decrease of plasma density also causes a corresponding decrease in the ion densities of the beamlets and, thus, a decrease in their positive space charges which tend to radially expand the beamlets.

Because of the cumulative effects of these variations, beamlet 46 passes through its aperture set, beamlet 48 begins to exhibit some crossover in its ion trajectories and several ion trajectories of beamlet 50 terminate on the decelerator grid 26. Ions on these latter trajectories sputter atoms from the decelerator grid.

In tests, this sputtering has been observed to erode a decelerator grid of an ion-optics system in operational test times (e.g., ~500 hours) far less than the lifetime requirements cited above. Accordingly, cross-over ion erosion has prevented the realization of the lifetime requirements cited above. In addition, sputtered atoms from the decelerator grid may be deposited on sensitive spacecraft surfaces, e.g., solar cells.

SUMMARY OF THE INVENTION

The present invention is directed to ion thrusters which achieve lifetimes that are compatible with modern spacecraft requirements. In particular, the invention is directed to ion-optics systems which reduce erosion effects that limit system lifetimes.

This goal is achieved with a multiple-grid ion-optics system which has an array of aperture sets in which aperture areas change in a perimeter region of the array. In one ion-optics system embodiment, a screen aperture area is reduced in aperture sets that are proximate to the perimeter of the array. In prototype tests of this embodiment, erosion of grids (e.g., a decelerator grid) was reduced to the point that it was not observable after ~914 hours of operation.

It is theorized that this observed erosion reduction occurs because the reduced screen aperture area decreases the bulge of a plasma sheath adjacent to the screen grid and thereby decreases the initial angles of ion trajectories.

In another ion-optics system embodiment, a decelerator aperture area is increased in aperture sets that are proximate to the perimeter of the array. In different ion-optics system embodiments, grid apertures have circular and hexagonal configurations.

The novel features of the invention are set forth with particularity in the appended claims. The invention will be best understood from the following description when read in conjunction with the accompanying drawings.

DETAILED DESCRIPTION OF THE PREFERRED EMBODIMENTS

Figure 2:
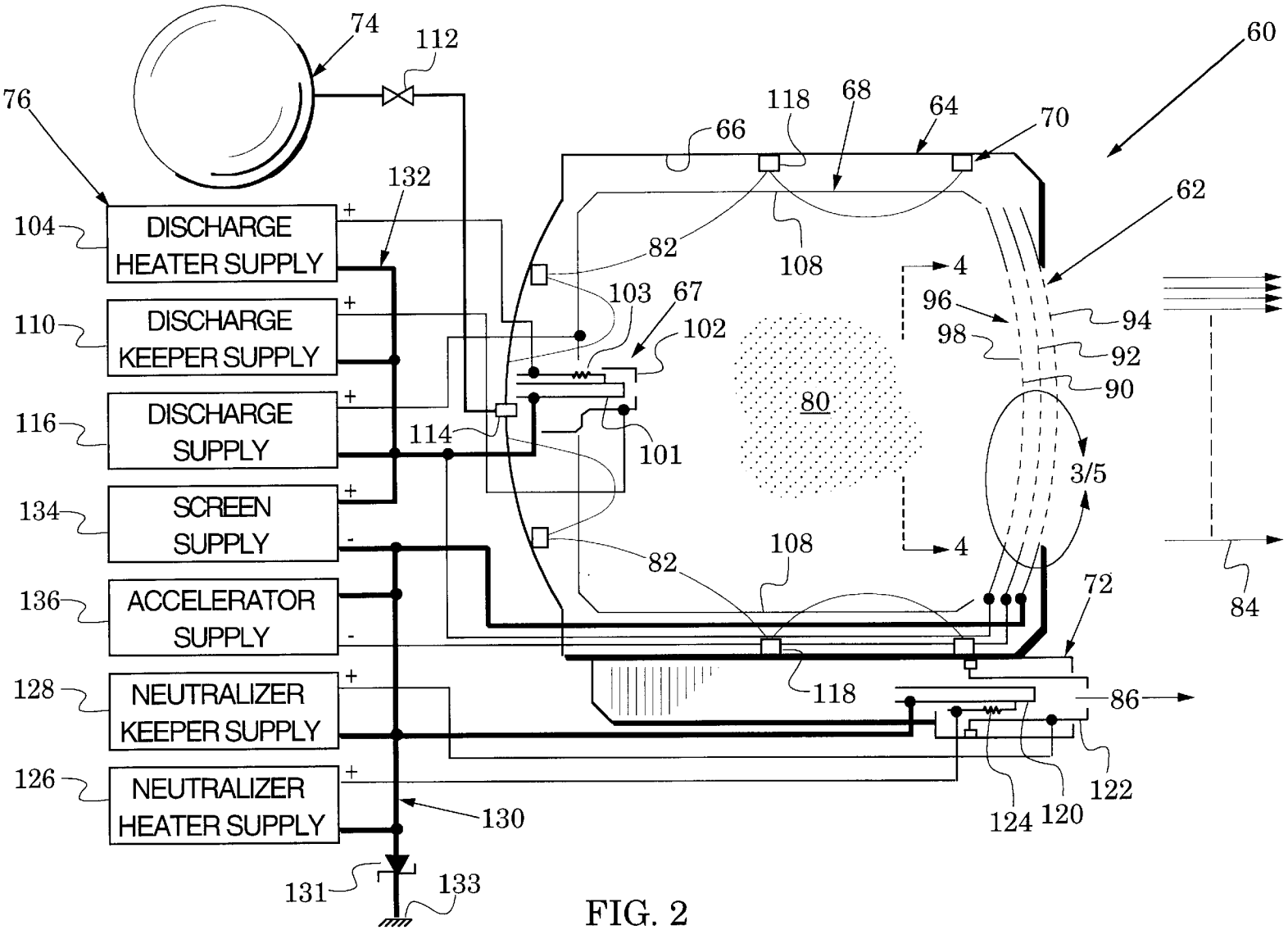
FIG. 2 is a side elevation view of an ion thruster system in accordance with the present invention.

FIG. 2 illustrates an ion thruster 60 whose lifetime is enhanced by the improved performance of an ion-optics system 62. The ion thruster 60 also includes a housing 64 which forms an ionization chamber 66, a discharge electron source 67 and an electrode system 68 which are positioned within the chamber 66, a magnetic field generator 70 which is also positioned within the chamber 66, a neutralizer 72 positioned adjacent the ion-optics system 62, a vessel 74 configured to contain a supply of an ionizable gas (e.g., xenon), and a power supply system 76 which generates bias voltages for application to various thruster structures.

In a basic operation of the ion thruster 60, an ionizable gas is coupled to the chamber 66 from the vessel 74 and primary electrons are injected into the gas from the discharge electron source 67. A discharge voltage applied to the electrode system 68 accelerates these electrons into collisions with gas atoms and these collisions create free ions and secondary electrons. This is a repetitive process which generates a plasma 80 of ions and electrons in the chamber 66 (for clarity of illustration, the plasma is indicated in only a portion of the chamber). The magnetic field generator 70 is configured to develop magnetic flux lines 82 proximate to the housing 64. The flux lines 82 cause electrons to travel along extensive paths prior to being collected by the electrode system 68. These extensive electron paths increase the number of collisions with gas atoms and thus enhance the generation of the plasma 80.

From the plasma source 80, the ion-optics system 62 forms a plurality of ion beamlets that combine as an ion beam 84 which is accelerated away from the ion-optics system 62. The ion beam 84 issues from the ion-optics system 62 and its momentum generates a force upon the ion thruster 60 and structures (e.g., a spacecraft) which are attached to the thruster. If not otherwise compensated, the positive charge flow of the ion beam 84 would develop a negative charge on the ion thruster that would degrade the thruster's force. Accordingly, the neutralizer 72 injects an electron stream 86 into the proximity of the ion beam 84 to offset its charge-depleting effects on the thruster 60. In addition, the electron stream 86 at least partially neutralizes the positive space charge of the ion beam 84 to prevent excessive divergence of the beam.

Having described the basic operation of the ion thruster 60, it is noted that the ion-optics system 62 has a screen grid 90, an accelerator grid 92 and a decelerator grid 94. An array 96 of aperture sets 98 are formed by these grids. Voltages developed by the power supply system 76 are applied to the grids to cause each of the aperture sets 98 to generate a respective one of the ion beamlets of the ion beam 84. The grids of the ion-optics system 62 preferably have a spherical configuration to enhance their stability over a range of thermal environments. Although the grids are shown to bulge outward in FIG. 2, an opposite arrangement may be used.

A further description of the structure and operation of the ion-optics system 62 is enhanced by preceding it with a more thorough description of the other ion thruster systems. Accordingly, attention is now directed to the details of these systems.

The discharge electron source 67 includes a cathode 101, a keeper electrode 102 and a heater 103 (symbolized by a resistor) which receives current from a discharge heater supply 104 of the power supply system 76. The electron source typically has a coating (e.g., barium calcium aluminate) which is converted by thermal heating into an oxide (e.g., barium oxide) that coats a tungsten dispenser whose low work function facilitates the emission of electrons. A discharge keeper supply 110 of the power supply system 76 places a positive voltage on the keeper electrode 102 so as to initiate a plasma discharge and provide electrons to the chamber 66 (i.e., the supply 110 "keeps" a plasma discharge between the cathode 101 and keeper 102 present in the chamber 66).

In one embodiment, the electrode system 68 also includes the cathode 101 and includes an anode 108 (formed, for example, of stainless steel) that is positioned adjacent the housing 64.

The containment vessel 74 is coupled to the ionization chamber 66 by a valve 112 and a flow orifice 114. After the valve 112 is opened by a thruster control system, the flow orifice 114 meters ionizable gas into the chamber. A discharge voltage is placed across the electron source 67 and the anode liner 108 by a discharge supply 116 of the power supply system 76. A positive potential of the discharge supply 116 is coupled to the anode liner 108 and this potential attracts and accelerates the primary electrons through the ionizable gas. The magnetic field generator 70 preferably includes a plurality of annular permanent magnets 118 which are positioned adjacent the housing 64 and arranged to develop cusp-shaped magnetic field lines 82 which enhance plasma generation as described above.

The neutralizer 72 includes a neutralizer cathode 120, a keeper electrode 122 and a heater 124 which are substantially the same as the cathode 101, keeper electrode 102 and heater 103 that are positioned in the chamber 66. A neutralizer heater supply 126 of the power supply system 76 is coupled across the heater 124 to generate an electron supply and a neutralizer keeper supply 128 of the power supply system 76 places a positive voltage on the keeper electrode 122 to initiate a plasma discharge which is the source of the electron stream 86.

The power supply system 76 has a lower supply bus 130 and an upper supply bus 132. The lower supply bus 130 is referenced to a spacecraft "ground" 133 and the potentials of the supply buses 130 and 132 are electrically spaced apart by the voltage differential of a screen supply 134. The lower supply bus 130 references the neutralizer keeper supply 128, the neutralizer heater supply 126, an accelerator supply 136 and the decelerator grid 94 to the neutralizer's electron source 120. A zener diode 131 in the lower supply bus 130 allows it to float negative with respect to the spacecraft potential to realize a potential which causes the electron stream 86 to equalize the ion beam 84. The upper supply bus 132 references the discharge supply 116, the discharge keeper supply 110, the discharge heater supply 104 and the screen grid 90 to the discharge electron source 67.

Figure 3:
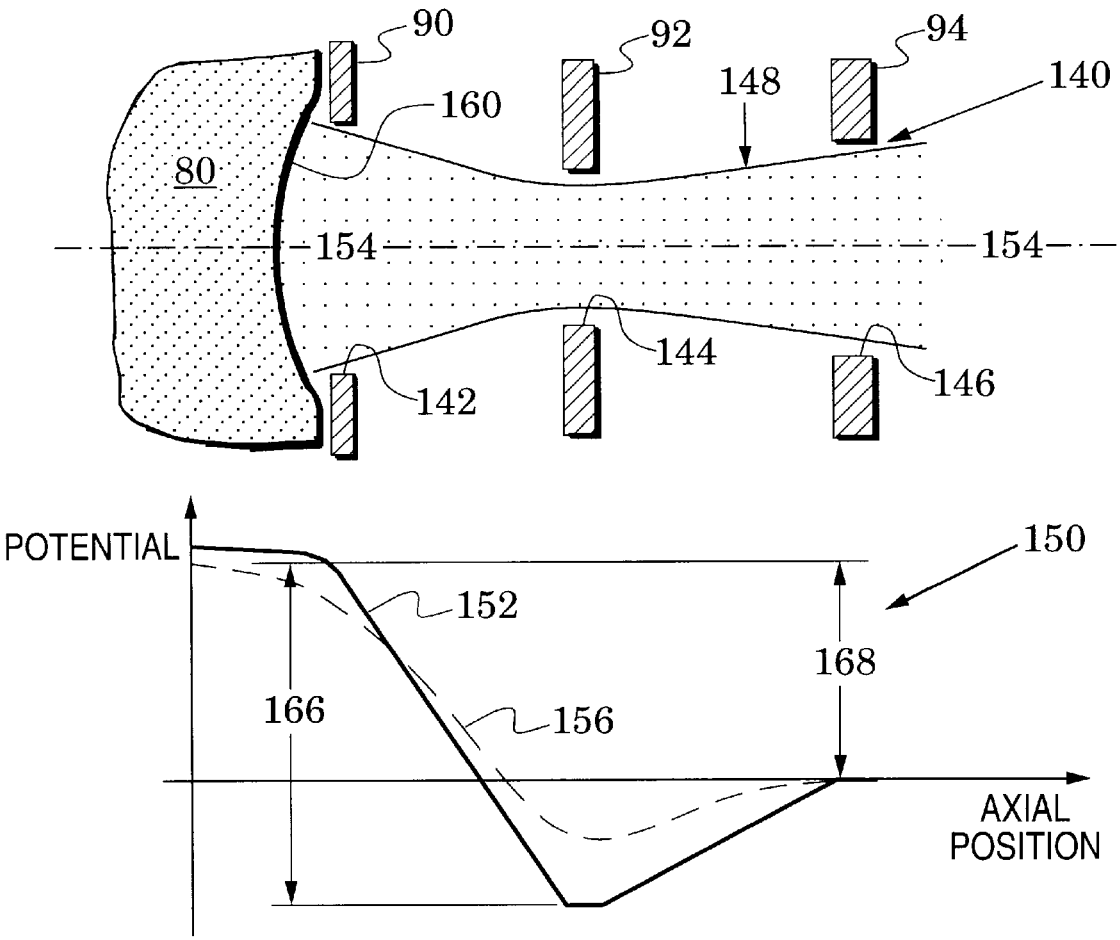
FIG. 3 is an enlarged cross sectional view of an exemplary aperture set within the curved line 3/5 of FIG. 2 and this view is aligned with a graph of exemplary electric potentials.

Having described the other systems of the ion thruster 60 of FIG. 2, attention is now redirected to the structure and operation of the ion-optics system 62. FIG. 3 illustrates exemplary potentials which are applied to this system by elements of the power supply system 76 (in particular, the screen supply 134 and the accelerator supply 136). In this figure, an exemplary aperture set 140 (one of the aperture sets 98 of FIG. 2) includes a screen aperture 142, an accelerator aperture 144 and a decelerator aperture 146. An ion beamlet 148 is generated by the aperture set 140 from the plasma 80 (also shown in FIG. 2) which lies proximate to the screen grid 90. FIG. 3 also has a graph 150 of electric potentials and this graph is aligned with the aperture set 140 to illustrate the potentials that are distributed across the aperture set.

Relative to the plasma 80, the screen grid 90 is typically biased negative. In an exemplary potential distribution, the screen grid 90 and the plasma 80 are respectively 720 and 750 volts above the potential (133 in FIG. 2) of a spacecraft that is coupled to the ion thruster. The spacecraft potential is substantially that of the space plasma which surrounds the spacecraft. The plasma 80 basically takes on the potential of the anode liner (68 in FIG. 2). In this exemplary potential distribution, the accelerator grid 92 is biased 300 volts below the spacecraft potential (133 in FIG. 2) and the decelerator grid 94 is biased 20 volts below the spacecraft potential.

These potential variations through the grids are indicated by the solid potential plot 152 in the graph 150 and the potential variations along the axis 154 of the aperture set 140 are indicated by the broken potential plot 156. The axial potential near the accelerator grid 92 is higher than the grid potential due to geometrical effects and the space charge of the ion beamlet 148.

Depletion of ions (which migrate to generate the ion beamlet 148) causes the plasma 80 to form a plasma face or sheath 160 (similar to the sheath 52 of FIGS. 1A–1C) which bulges into the ionization chamber (66 in FIG. 2). The plasma sheath 160 repels electrons in the plasma 80 and attracts ions which then flow through the screen aperture 142.

In generation of the ion beamlet 148, the screen aperture 142 facilitates the flow of ions from the plasma 80 and the potential in the accelerator aperture 144 accelerates the ions which are then decelerated slightly as they pass between the accelerator grid 92 and the decelerator grid 94. In addition to accelerating ions, the accelerator grid prevents "back-streaming" of electrons in the ion beamlet 148 to the plasma 80.

The decelerator aperture 146 provides a collimating influence on the ion beamlet 148 and the decelerator grid 94 collects debris which may be sputtered from the accelerator grid 92. Thus, the decelerator grid reduces contamination effects of the ion beam (84 in FIG. 2) upon sensitive spacecraft surfaces (e.g., solar cells). The potentials on the grids form a total acceleration voltage 166 and a net acceleration voltage 168 which are indicated in the graph 150.

The functions of the apertures of the aperture set 140 are generally enhanced by forming the screen aperture 142 with the largest area and the accelerator aperture 144 with the smallest area. In addition, it has generally been found that the current of the ion beamlet 148 remains substantially constant as aperture areas are reduced. Thus, increasing the number of aperture sets 98 in the array 96 of FIG. 2 generally increases the current of the ion beam 84 of FIG. 2. This increase in aperture sets is typically obtained by reducing the aperture areas as much as is structurally feasible.

Figure 4:
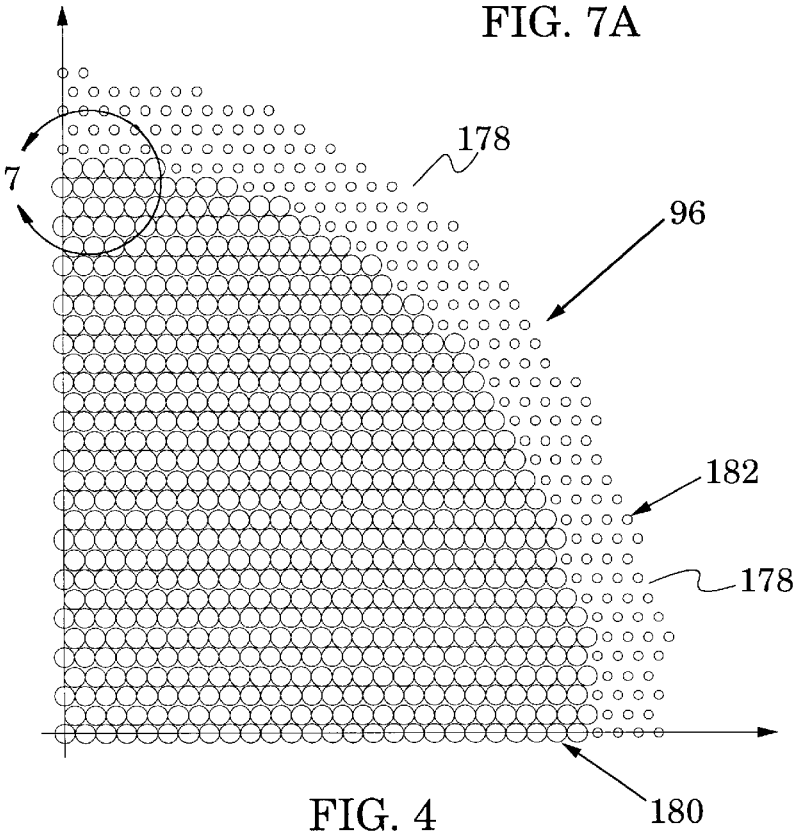
FIG. 4 is an enlarged view along the plane 4—4 of FIG. 2 which shows one quadrant of an array of aperture sets.

Structures of the ion-optics system (62 in FIG. 2) are further illustrated in FIG. 4 which is a view of the aperture set array 96 along the plane 4—4 of FIG. 2. For clarity of illustration, only a representative quadrant of the array 96 is shown in FIG. 4. Although this view shows only the screen apertures, it is apparent that each screen aperture is a member of one of the aperture sets 98 of FIG. 2.

FIG. 4 illustrates that the array 96 has a perimeter 178, a first group 180 of aperture sets in which the screen apertures have a first aperture area and a second group 182 of aperture sets in which the screen apertures have a second aperture area that is reduced from the first aperture area. The second group 182 of aperture sets is proximate to the array perimeter 178 and surrounds the first group 180 of aperture sets. It has been found in prototype testing that this reduction of screen aperture areas proximate to the array perimeter 178 greatly reduces the deceleration grid erosion of conventional ion thrusters (as illustrated in FIG. 1C).

Figure 5A:
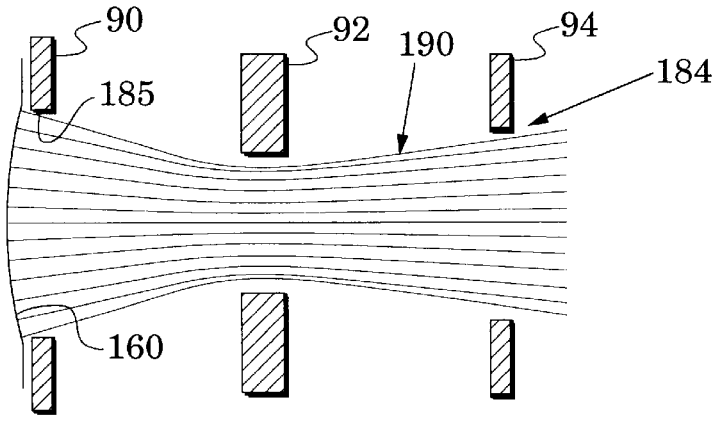
FIGS. 5A–5C are enlarged cross sectional views of representative aperture sets within the curved line 3/5 of FIG. 2 which illustrate ion trajectories in those aperture sets.
Figure 5B:
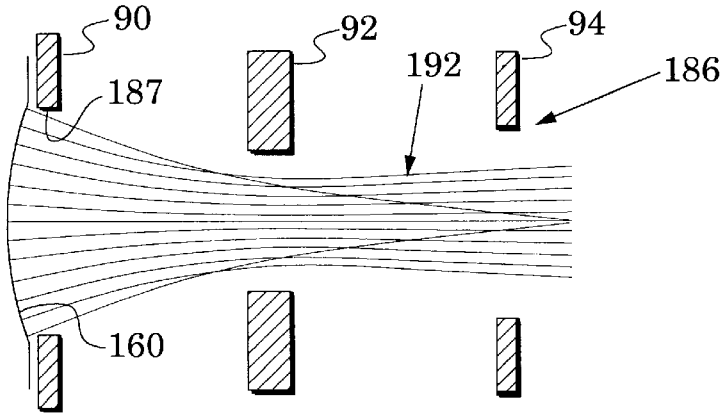
Figure 5C:
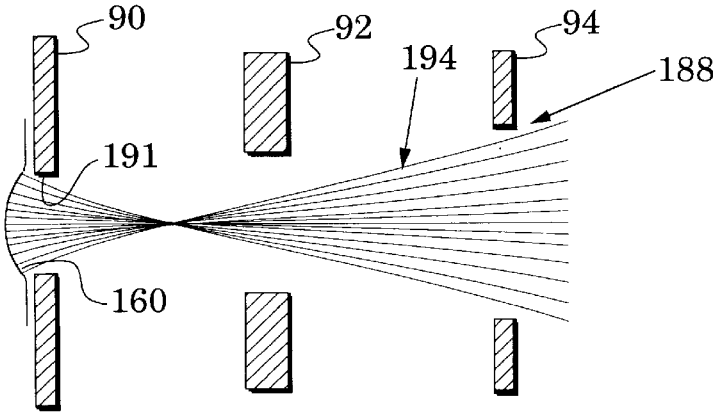

A theorized operation of the aperture set array 96 of FIG. 4 is illustrated in FIGS. 5A–5C which are views of representative aperture sets within the curved line 3/5 of FIG. 2. In particular, FIG. 5A shows a cross section through an aperture set 184 which is near the center of the array 96 of FIG. 4, FIG. 5C shows a cross section through an aperture set 188 which is proximate to the array perimeter 178 of FIG. 4 and FIG. 5B shows a cross section through an aperture set 186 which is between the aperture sets 184 and 188.

Ion beamlets 190, 192 and 194 flow through aperture sets 184, 186 and 188 respectively. Aperture sets 184 and 186 are members of the first group 180 of aperture sets of FIG. 4 and thus their screen apertures 185 and 187 have the first aperture area shown in that figure. In contrast, the aperture set 188 is a member of the second group 182 of aperture sets and its screen aperture 191 has the second aperture area of FIG. 4 which is reduced from the first aperture area.

The density of the plasma source (80 in FIG. 2) decreases from a maximum at the center of the array 96 to a minimum at the array perimeter 178. Accordingly, FIGS. 5A–5C show that a plasma sheath 160 increasingly bulges away from the screen grid 90 and initiates increasingly angled ion trajectories with greater proximity to the array perimeter 178. Simultaneously, there is a corresponding decrease in the ion densities of the beamlets 190, 192 and 194 and, thus, a decrease in their positive space charges.

Figure 1A:
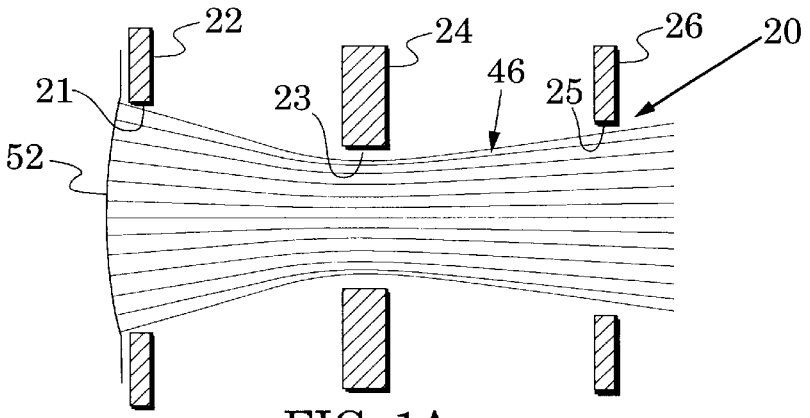
FIG. 1A (PRIOR ART)
FIGS. 1A–1C are cross sectional views of different aperture sets in a conventional ion-optics system which illustrate typical ion trajectories in those aperture sets.
Figure 1B:
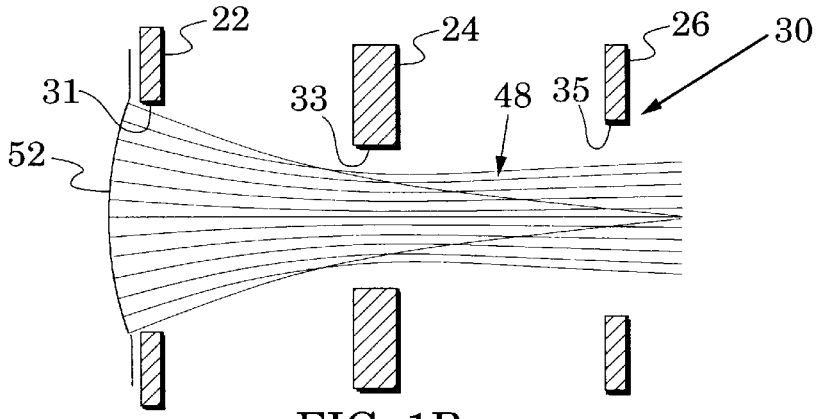
FIG. 1B (PRIOR ART)
Figure 1C:
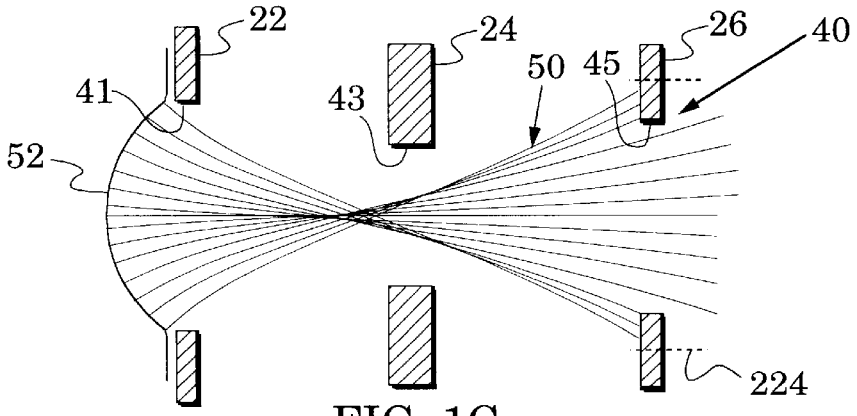
FIG. 1C (PRIOR ART)

Because screen aperture areas of the aperture sets 184 and 186 are similar to those shown in FIGS. 1A and 1B, the shape of the ion beamlets 184 and 186 are similar to the beamlets 46 and 48 of FIGS. 1A and 1B. In contrast with FIG. 1C, however, the reduced aperture area of the screen aperture 191 in FIG. 5C decreases the bulge of the plasma sheath 160 and decreases the initial angles of ion trajectories so that the ion beamlet 194 does not impinge upon the decelerator grid 94.

A prototype ion-optics system was fabricated in accordance with the concepts illustrated in FIGS. 4 and 5A–5C, i.e., with reduced screen apertures in the perimeter region of the aperture-set array. This prototype was then operated for ~914 hours. After disassembly, the ion-optics system was carefully inspected and found to have no observable erosion.

As a result of the prototype tests, an exemplary ion-optics system was determined for an ion thruster with a nominal diameter of 13 centimeters. This exemplary system has an array of 3145 aperture sets of which a second group (182 in FIG. 4) of 738 aperture sets are positioned to surround a first group (180 in FIG. 4) of 2407 aperture sets and to be proximate to an array perimeter (178 in FIG. 4).

The screen apertures of the first group have a diameter of ~1.91 millimeters and the screen apertures of the second group have a diameter of ~0.76 millimeters. The grid material is molybdenum with the screen grid and the decelerator grid having a thickness of ~0.25 millimeters and the accelerator grid having a thickness of ~0.50 millimeters.

Figure 6:
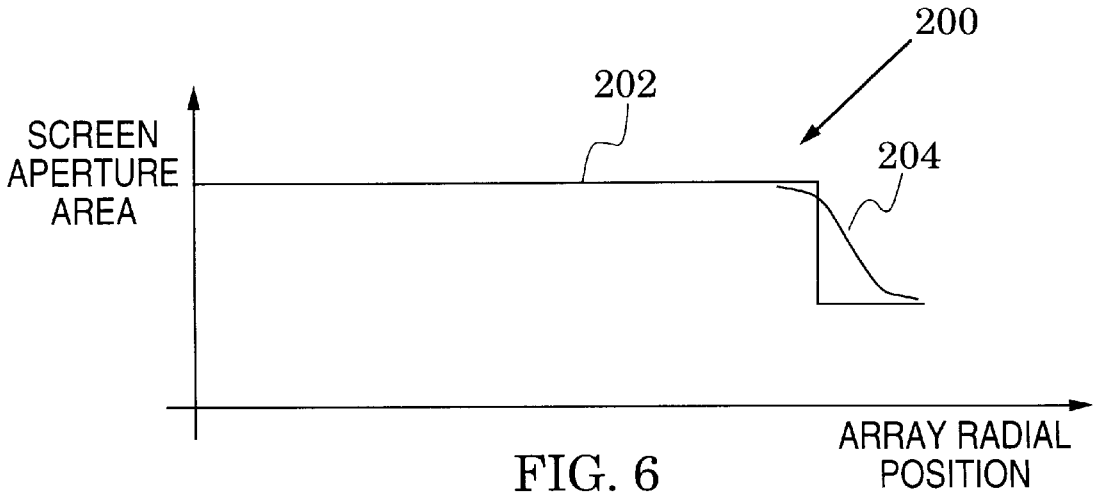
FIG. 6 is a graph which shows screen aperture area as a function of radial distance in the array of FIG. 4.

The graph 200 of FIG. 6 shows a plot 202 of screen aperture area as a function of radial distance in the array 96 of FIG. 4. In accordance with the first and second groups 180 and 182 of screen apertures of FIG. 4, the plot 202 has the shape of a step function. However, the teachings of the invention can be extended to other distributions of reduced screen aperture areas. For example, the screen aperture areas can be modified to monotonically reduce proximate to the array perimeter as indicated by the modified plot 204 in FIG. 6.

Figure 7B:
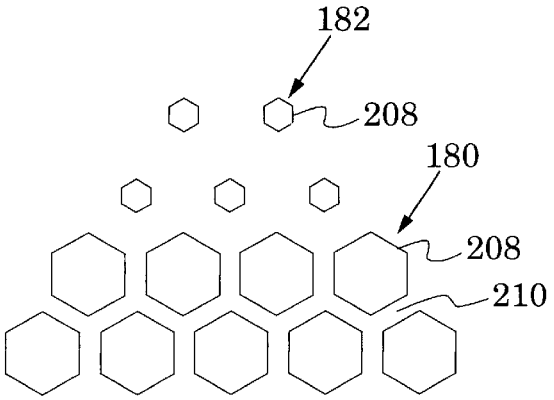
FIG. 7B is a view similar to FIG. 7A which shows another embodiment of a screen aperture configuration.
Figure 7A:
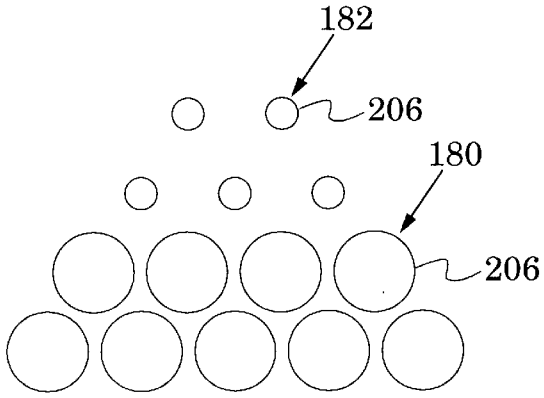
FIG. 7A is an enlarged view of the structure within the curved line 7 of FIG. 4 which shows one embodiment of a screen aperture configuration.

Although the array 96 of FIG. 4 has been described with reference to circular apertures, the teachings of the invention can be practiced with apertures of various configurations. For example, FIGS. 7A and 7B illustrate members of the first and second groups (180 and 182) of aperture arrays that are within the curved line 7 of FIG. 4. In FIG. 7A, the screen apertures have a circular configuration 206 and in FIG. 7B, they have a hexagonal configuration 208. As stated above, the current of the ion beam (84 in FIG. 2) is typically increased by packing a greater number of aperture sets within a given area. The hexagonal configuration of FIG. 7B is particularly suited to this packing operation while still maintaining structural integrity of the web 198 between the apertures. The hexagonal configuration also realizes a relatively small web area so that the web 198 intercepts a smaller portion of the ion beam 84. The number of aperture sets is generally increased by arranging the aperture sets in interleaved and offset rows as shown in FIGS. 4, 7A and 7B. In this arrangement, each aperture is surrounded by six adjacent apertures.

Figure 8:
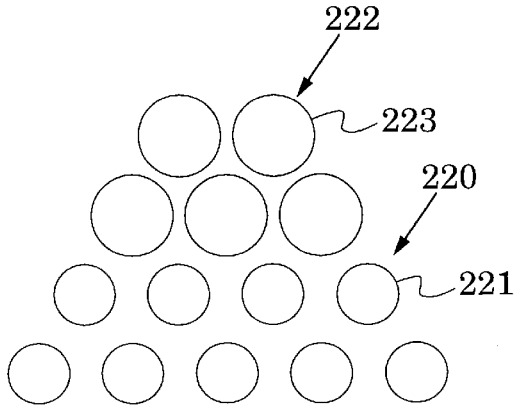
FIG. 8 is an enlarged view of a decelerator aperture configuration within the curved line 7 of FIG. 4.

The teachings of the invention can also be extended to other embodiments of reduced aperture areas. FIG. 8 is a view which is similar to FIG. 7A except it is a view of decelerator apertures in the perimeter region of the curved line 7 of FIG. 4 (i.e., it is a view of the opposite face of the ion-optics system). In this embodiment, there is a first group 220 of aperture sets in which the decelerator apertures have a first aperture area 221 and a second group 222 of aperture sets in which the decelerator apertures have a second aperture area 223 that is increased from the first decelerator aperture area. The second group 222 of aperture sets is proximate to the array perimeter 178 and surrounds the first group 200.

An exemplary decelerator aperture of the second group 222 is indicated by broken lines 224 in FIG. 1C. It is apparent that the area of this aperture can be selected to reduce the ion erosion caused by impact of the ion beamlet 50 in FIG. 1C.

Although the ion-optics system 62 of FIG. 2 has been illustrated as a three-grid system, the concepts of the invention can be used to reduce ion erosion and protect spacecraft surfaces in any multiple-grid ion-optics system. In a two grid system (screen and accelerator grids), for example, an aperture pattern similar to that of FIG. 4 can be applied to the screen grid.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A multiple-grid ion-optics system for generating ion beamlets from a plasma source in an ion thruster, comprising:

a screen grid;

an accelerator grid spaced from said screen grid;

a decelerator grid spaced from said accelerator grid and positioned so that said accelerator grid is between said screen grid and said decelerator grid; and an array of aperture sets, said array having an array perimeter and said aperture sets divided into a first group of aperture sets and a second group of aperture sets that are proximate to said array perimeter and that surround said first group and each of said aperture sets including:

a screen aperture formed by said screen grid to facilitate the flow of a respective one of said ion beamlets from said plasma source, wherein said screen aperture has a first screen aperture area in said first group and a second screen aperture area in said second group which is reduced from said first screen aperture area;

an accelerator aperture formed by said accelerator grid to have an accelerator aperture area and positioned so that an accelerator voltage on said accelerator grid attracts said respective ion beamlet and accelerates it through said accelerator aperture, wherein said accelerator aperture area is constant throughout said first and second groups; and a decelerator aperture formed by said decelerator grid to have a decelerator aperture area and positioned so that a decelerator voltage on said decelerator grid at least partially collimates said respective ion beamlet, wherein said decelerator aperture area is constant throughout said first and second groups;

the reduced second screen aperture area reducing ion erosion of said decelerator grid.

2. The multiple-grid ion-optics system of claim 1, wherein said second group of aperture sets includes N subgroups whose second screen aperture areas monotonically decrease with increasing proximity to said perimeter.

3. The multiple-grid ion-optics system of claim 1, wherein said screen aperture, said accelerator aperture and said decelerator aperture each have a circular cross section.

4. The multiple-grid ion-optics system of claim 1, wherein said screen aperture, said accelerator aperture and said decelerator aperture each have a hexagonal cross section.

5. The multiple-grid ion-optics system of claim 1, wherein the aperture sets of said array are arranged in rows with a first plurality of said rows offset from a second plurality of said rows.

6. The multiple-grid ion-optics system of claim 1, wherein said screen grid, said accelerator grid and said decelerator grid have a spherical configuration to enhance their thermal stability.

7. The multiple-grid ion-optics system of claim 1, wherein said array has a circular configuration.

8. A multiple-grid ion-optics system for generating ion beamlets from a plasma source in an ion thruster, comprising:

a screen grid;

an accelerator grid spaced from said screen grid;

a decelerator grid spaced from said accelerator grid and positioned so that said accelerator grid is between said screen grid and said decelerator grid; and an array of aperture sets, said array having an array perimeter and said aperture sets divided into a first group of aperture sets and a second group of aperture sets that are proximate to said array perimeter and that surround said first group and each of said aperture sets including:

a screen aperture formed by said screen grid to facilitate the flow of a respective one of said ion beamlets from said plasma source and having a screen aperture area that is constant throughout said first and second groups;

an accelerator aperture formed by said accelerator grid to have an accelerator aperture area and positioned so that an accelerator voltage on said accelerator grid attracts said respective ion beamlet and accelerates it through said accelerator aperture, wherein said accelerator aperture area is constant throughout said first and second groups; and a decelerator aperture formed by said accelerator grid and positioned so that a decelerator voltage on said decelerator grid at least partially collimates said respective ion beamlet, said decelerator aperture having a first decelerator aperture area in said first group and a second decelerator aperture area in said second group which is increased from said first decelerator aperture area;

the increased second decelerator aperture area reducing ion erosion of said decelerator grid.

9. The multiple-grid ion-optics system of claim 8, wherein said second group of aperture sets includes N subgroups whose second decelerator aperture areas monotonically increase with increasing proximity to said perimeter.

10. The multiple-grid ion-optics system of claim 8, wherein said screen aperture, said accelerator aperture and said decelerator aperture each have a circular cross section.

11. The multiple-grid ion-optics system of claim 8, wherein said screen aperture, said accelerator aperture and said decelerator aperture each have a hexagonal cross section.

12. An ion thruster for generating an ion beam which is formed from a plurality of ion beamlets, comprising:

a housing;

a chamber formed by said housing for receiving an ionizable gas, said chamber having an open end;

an electron source positioned to inject primary electrons into said chamber;

an electrode system positioned in said chamber to receive electrode voltages for acceleration of said primary electrons and ionization of said gas into a plasma source;

a magnet system positioned in said chamber and configured to generate magnetic field lines proximate to said housing to enhance said ionization;

a multiple-grid ion-optics system positioned across said open end and having;

a screen grid;

an accelerator grid spaced from said screen grid;

a decelerator grid spaced from said accelerator grid and positioned so that said accelerator grid is between said screen grid and said decelerator grid; and an array of aperture sets, said array having an array perimeter and said aperture sets divided into a first group of aperture sets and a second group of aperture sets that are proximate to said array perimeter and that surround said first group and each of said aperture sets including:

a screen aperture formed by said screen grid to facilitate the flow of a respective one of said ion beamlets from said plasma source, wherein said screen aperture has a first screen aperture area in said first group and a second screen aperture area in said second group which is reduced from said first screen aperture area;

an accelerator aperture formed by said accelerator grid to have an accelerator aperture area and positioned so that an accelerator voltage on said accelerator grid attracts said respective ion beamlet and accelerates it through said accelerator aperture, wherein said accelerator aperture area is constant throughout said first and second groups; and a decelerator aperture formed by said decelerator grid to have a decelerator aperture area and positioned so that a decelerator voltage on said decelerator grid at least partially collimates said respective ion beamlet, wherein said decelerator aperture area is constant throughout said first and second groups;

and a neutralizer configured and positioned to inject neutralizing electrons into a region which is proximate to said ion beamlets.

13. The ion thruster of claim 12, wherein said electrode system includes:

a hollow cathode positioned in said chamber; and an anode positioned proximate to said housing.

14. The ion thruster of claim 12, wherein said magnet system includes a plurality of annular permanent magnets positioned proximate to said housing.

15. The ion thruster of claim 12, further including a power supply system configured to supply said accelerator voltage and said decelerator voltage.

16. The ion thruster of claim 12, further including:

a vessel for containing a supply of said ionizable gas; and a flow orifice coupled between said chamber and said vessel for delivering ionizable gas to said chamber.

17. The ion thruster of claim 12, wherein said neutralizer includes:

a source of neutralizing electrons; and an neutralizer electrode positioned to receive a neutralizer voltage for injection of said neutralizing electrons.

18. An ion thruster for generating an ion beam which is formed from a plurality of ion beamlets, comprising:

a housing;

a chamber formed by said housing for receiving an ionizable gas, said chamber having an open end;

an electron source positioned to inject primary electrons into said chamber;

an electrode system positioned in said chamber to receive electrode voltages for acceleration of said primary electrons and ionization of said gas into a plasma source;

a magnet system positioned in said chamber and configured to generate magnetic field lines proximate to said housing to enhance said ionization;

a multiple-grid ion-optics system positioned across said open end and having;

a screen grid;

an accelerator grid spaced from said screen grid;

a decelerator grid spaced from said accelerator grid and positioned so that said accelerator grid is between said screen grid and said decelerator grid; and an array of aperture sets, said array having an array perimeter and said aperture sets divided into a first group of aperture sets and a second group of aperture sets that are proximate to said array perimeter and that surround said first group and each of said aperture sets including:

a screen aperture formed by said screen grid to facilitate the flow of a respective one of said ion beamlets from said plasma source and having a screen aperture area that is constant throughout said first and second groups;

an accelerator aperture formed by said accelerator grid to have an accelerator aperture area and positioned so that an accelerator voltage on said accelerator grid attracts said respective ion beamlet and accelerates it through said accelerator aperture, wherein said accelerator aperture area is constant throughout said first and second groups; and a decelerator aperture formed by said accelerator grid and positioned so that a decelerator voltage on said decelerator grid at least partially collimates said respective ion beamlet, said decelerator aperture having a first decelerator aperture area in said first group and a second decelerator aperture area in said second group which is increased from said first decelerator aperture area;

and a neutralizer configured and positioned to inject neutralizing electrons into a region which is proximate to said ion beamlets.

19. The ion thruster of claim 18, wherein said electrode system includes:

a hollow cathode positioned in said chamber; and an anode positioned proximate to said housing.

20. The ion thruster of claim 18, wherein said magnet system includes a plurality of annular permanent magnets positioned proximate to said housing.

* * * * *